US011012781B2

(12) United States Patent
Kang et al.

(10) Patent No.: US 11,012,781 B2
(45) Date of Patent: May 18, 2021

(54) DISPLAY APPARATUS

(71) Applicant: LG Display Co., Ltd., Seoul (KR)

(72) Inventors: Sung-Jin Kang, Paju-si (KR); Jeonggoo Kang, Paju-si (KR); JaiHyuk Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/506,088

(22) Filed: Jul. 9, 2019

(65) Prior Publication Data

US 2020/0068311 A1 Feb. 27, 2020

(30) Foreign Application Priority Data

Aug. 22, 2018 (KR) ..... 10-2018-0097815

(51) Int. Cl.
*H04R 17/00* (2006.01)
*H04R 7/04* (2006.01)

(52) U.S. Cl.
CPC ..... *H04R 7/045* (2013.01); *H04R 2499/15* (2013.01)

(58) Field of Classification Search
CPC ..... H04R 2440/00; H04R 2440/05; H04R 2440/07; H04R 2499/15; H04R 7/04
See application file for complete search history.

(56) References Cited

U.S. PATENT DOCUMENTS 5,901,231 A * 5/1999 Parrella ..... H04R 17/00 381/86
6,332,029 B1 * 12/2001 Azima ..... B42D 15/022 381/152
7,403,628 B2 * 7/2008 Murray ..... H04R 7/045 381/152
9,148,716 B2 9/2015 Liu et al.
9,591,391 B2 3/2017 Liu et al.
10,659,858 B2 * 5/2020 Lee ..... H04R 7/045
10,659,871 B2 * 5/2020 Kim ..... H04R 1/347
(Continued)

FOREIGN PATENT DOCUMENTS

CN 1108536 C 5/2003
CN 105487276 A 4/2016
(Continued)

OTHER PUBLICATIONS

Office Action dated Jul. 22, 2020, issued in corresponding Japanese Patent Application No. 2019-152010 from the Japanese Patent Office.
Office Action dated Sep. 1, 2020, issued in corresponding Chinese Patent Application No. 201910772966.X from the Chinese Patent Office. Note: WO 2018/123310 A1 cited therein is already of record.

*Primary Examiner* — Ryan Robinson
(74) *Attorney, Agent, or Firm* — Morgan, Lewis & Bockius LLP

(57) ABSTRACT

A display apparatus includes a display panel configured to display an image; a rear structure supporting the display panel and including a through hole in a thickness direction; a vibration generating device including at least one sound generating module in the through hole to vibrate the display panel; a vibration transfer member between the display panel and the vibration generating device, the vibration transfer member configured to transfer a vibration of the vibration generating device to the display panel; and a buffer member on one of the display panel and the rear structure.

22 Claims, 13 Drawing Sheets

(56) References Cited

U.S. PATENT DOCUMENTS

| | | | | |
|---|---|---|---|---|
| 2009/0232333 | A1* | 9/2009 | Kondo | H04R 7/045 381/162 |
| 2010/0067726 | A1 | 3/2010 | Suzuki et al. | |
| 2014/0301596 | A1 | 10/2014 | Wang et al. | |
| 2015/0341714 | A1 | 11/2015 | Ahn et al. | |
| 2016/0219372 | A1 | 7/2016 | Wang et al. | |
| 2017/0280216 | A1 | 9/2017 | Lee et al. | |
| 2017/0280234 | A1 | 9/2017 | Choi et al. | |
| 2017/0280243 | A1* | 9/2017 | Choi | H04R 9/066 |
| 2019/0028787 | A1 | 1/2019 | Masuda et al. | |
| 2020/0004364 | A1* | 1/2020 | Jung | G06F 3/016 |
| 2020/0059713 | A1* | 2/2020 | Noh | G06F 1/1684 |
| 2020/0160760 | A1* | 5/2020 | Park | H04R 9/066 |

FOREIGN PATENT DOCUMENTS

| | | | |
|---|---|---|---|
| CN | 107241675 | A | 10/2017 |
| CN | 108124218 | A | 6/2018 |
| EP | 2164279 | B1 | 10/2016 |
| EP | 3 331 251 | A1 | 6/2018 |
| EP | 3 499 337 | A1 | 6/2019 |
| JP | 2010-081142 | A | 4/2010 |
| JP | 2017-184223 | A | 10/2017 |
| KR | 10-2014-0076492 | A | 6/2014 |
| KR | 10-2018-0049383 | A | 5/2018 |
| KR | 10-2019-0052467 | A | 5/2019 |
| WO | 2018/123310 | A1 | 7/2018 |

* cited by examiner

DISPLAY APPARATUS

This application claims the benefit of the Korean Patent Application No. 10-2018-0097815 filed on Aug. 22, 2018, which is hereby incorporated by reference as if fully set forth herein.

BACKGROUND

Technical Field

The present disclosure relates to a display apparatus.

Discussion of the Related Art

Recently, as society advances to the information-oriented society, the field of display apparatuses for visually displaying an electrical information signal has rapidly advanced. Consequently, various display apparatuses having excellent performance characteristics, such as thin profile, light weight, and low power consumption, are being developed. Examples of the display apparatuses may include liquid crystal display (LCD) apparatuses, field emission display (FED) apparatuses, organic light emitting display apparatuses, etc.

Generally, display apparatuses display an image on a display panel, but a separate speaker should be installed for providing sound. When a speaker is installed in a display apparatus, a traveling direction of sound output through the speaker is a direction toward a side end or an upper/lower end of the display panel instead of a front surface or a rear surface of the display panel. Thus, sound does not travel in a direction toward a viewer who is watching an image in front of the display panel, and an immersion experience of the viewer watching the image is hindered.

Moreover, when a speaker included in a set device, such as television (TV) is provided, the speaker occupies a certain space, and due to this, the design and space dispositions of the set device are limited.

SUMMARY

Accordingly, embodiments of the present disclosure are directed to a display apparatus that substantially obviates one or more problems due to limitations and disadvantages of the related art.

An aspect of the present disclosure is to provide a display apparatus so that, when watching an image in front of a display panel, a traveling direction of a sound becomes a direction toward a front surface of the display panel, thereby enhancing sound quality.

Another aspect of the present disclosure is to provide a display apparatus that outputs sound having a traveling direction that is a direction toward a front surface of a display panel, thereby enhancing sound quality.

Another aspect of the present disclosure is to provide a display apparatus that includes a buffer member attached on at least one of a display panel and a rear structure to define or limit a maximum displacement of a vibration generating device, thereby preventing the vibration generating device from being damaged by an external impact.

Another aspect of the present disclosure is to provide a display apparatus that includes a buffer member that is separated from a rear structure when a vibration generating device vibrates a display panel and contacts the rear structure when an external impact is applied to the display panel, thereby preventing the vibration generating device from being damaged by the external impact.

Another aspect of the present disclosure is to provide a display apparatus that includes a buffer member which is separated from a vibration generating device when the vibration generating device vibrates a display panel, and contacts the vibration generating device when an external impact is applied to the display panel, thereby preventing the vibration generating device from being damaged by the external impact.

Another aspect of the present disclosure is to provide a display apparatus in which a speaker is not separately disposed in a space other than a region of a display panel, and thus, a sense of design beauty is enhanced, thereby improving the image quality and sound quality of the display apparatus to enhance immersion of a viewer.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other advantages and in accordance with the purpose of the disclosure, as embodied and broadly described herein, a display apparatus comprises a display panel configured to display an image; a rear structure supporting the display panel and including a through hole in a thickness direction; a vibration generating device including at least one sound generating module in the through hole to vibrate the display panel; a vibration transfer member between the display panel and the vibration generating device, the vibration transfer member configured to transfer a vibration of the vibration generating device to the display panel; and a buffer member on one of the display panel and the rear structure.

In another aspect, a display apparatus comprises a display panel configured to display an image; a rear structure supporting the display panel and including a through hole bored along a thickness direction; a vibration generating device including at least one sound generating module inserted into the through hole to vibrate the display panel; a vibration transfer member between the display panel and the vibration generating device, the vibration transfer member configured to transfer a vibration of the vibration generating device to the display panel; and a buffer member including a first buffer member attached to the display panel and a second buffer member attached to the rear structure.

As described herein, a display apparatus according to example embodiments of the present disclosure may output a sound to a region in front of the display panel. Accordingly, a position of an image displayed by the display apparatus may match a position of a sound generated by the display apparatus, thereby enhancing immersion of a viewer who is watching the image displayed by the display apparatus.

Moreover, a display apparatus according to example embodiments of the present disclosure may include the buffer member attached on at least one of the display panel and the rear structure to define or limit a maximum displacement of the vibration generating device, thereby preventing the vibration generating device from being damaged by an external impact.

Further, a display apparatus according to example embodiments of the present disclosure may include the buffer member which is separated from the vibration generating device when the vibration generating device vibrates the display panel, and contacts the vibration generating device when an external impact is applied to the display panel, thereby preventing the vibration generating device from being damaged by the external impact.

Additionally, in a display apparatus according to example embodiments of the present disclosure, a speaker is not separately disposed in a space other than a region of a display panel, and thus, a sense of design beauty is enhanced, thereby improving the image quality and sound quality of the display apparatus to enhance immersion of a viewer.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
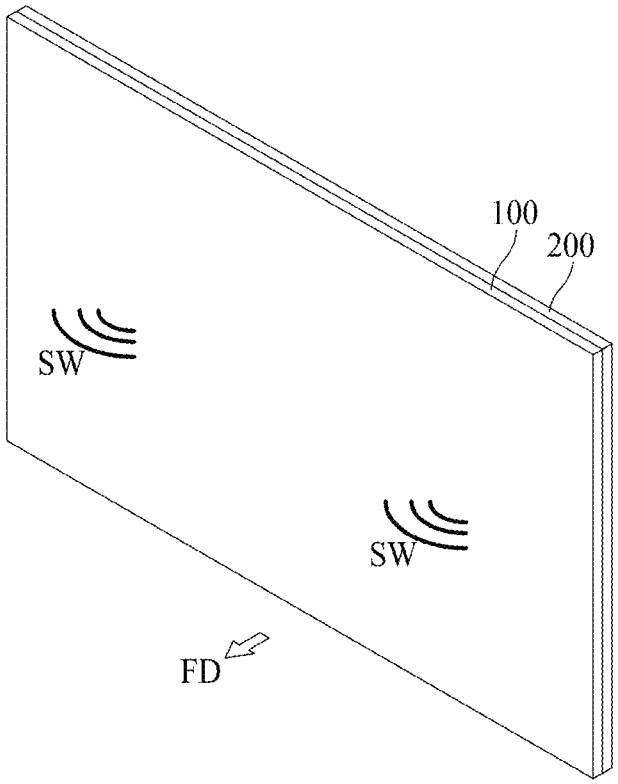
FIG. 1 is a perspective view of a display apparatus according to an embodiment of the present disclosure.

Reference will now be made in detail to embodiments of the present disclosure, examples of which may be illustrated in the accompanying drawings. In the following description, a detailed description of functions or configurations related to this document that are well-known to those skilled in the art may be omitted. The progression of processing steps and/or operations described is an example. The sequence of steps and/or operations is not limited to that set forth herein and may be changed as is known in the art or apparent to those skilled in the art, with the exception of steps and/or operations necessarily occurring in a particular order. Names of the respective elements used in the following explanations are selected only for convenience of writing the specification and may thus be different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Unless otherwise described, like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

In describing a time relationship, when the temporal order is described as, for example, "after," "subsequent," "next," or "before," a case which is not continuous may be included unless a more limiting term, such as "just," "immediate(ly)," or "direct(ly)," is used.

It will be understood that, although the terms like "first," "second," etc., may be used herein to describe various elements, these elements should not be limited by these terms as they are not used to define a particular order. These terms are used only to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" encompasses the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto, unless otherwise specified.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in a co-dependent relationship.

In the present disclosure, examples of a display apparatus may include a narrow-sense display apparatus, such as an organic light emitting display (OLED) module or a liquid crystal module (LCM), including a display panel and a driver for driving the display panel. Also, examples of the display apparatus may include a set device (or a set apparatus) or a set electronic device, such as a notebook computer, a TV, a computer monitor, an equipment apparatus including an automotive apparatus or another type of apparatus for vehicles, or a mobile electronic device, such as a smartphone or an electronic pad, which is a complete product (or a final product) including an LCM or an OLED module.

Therefore, examples of a display apparatus may include a narrow-sense display apparatus itself, such as an LCM or an OLED module, and a set device that is a final consumer device or an application product including the LCM or the OLED module.

Depending on the case, an LCM or an OLED module including a display panel and a driver may be referred to as a narrow-sense display apparatus, and an electronic device which is a final product including an LCM or an OLED module may be referred to as a set device. For example, the narrow-sense display apparatus may include a display panel, such as an LCD or an OLED, and a source printed circuit board (PCB) which is a controller for driving the display panel. The set device may further include a set PCB which is a set controller electrically connected to the source PCB to overall control the set device.

A display panel applied to the present embodiment may use all types of display panels such as a liquid crystal display panel, an organic light emitting diode (OLED) display panel, and an electroluminescent display panel, but is not limited to a specific display panel which is vibrated by a sound generation device according to the present embodiment to output a sound. Also, a shape or a size of a display panel applied to a display apparatus according to the present embodiment is not limited.

For example, if the display panel is the liquid crystal display panel, the display panel may include a plurality of gate lines, a plurality of data lines, and a plurality of pixels respectively provided in a plurality of pixel areas defined by intersections of the gate lines and the data lines. Also, the display panel may include an array substrate including a thin film transistor (TFT), which is a switching element for adjusting a light transmittance of each of the plurality of pixels, an upper substrate including a color filter and/or a black matrix, and a liquid crystal layer between the array substrate and the upper substrate.

Moreover, if the display panel is the organic light emitting display panel, the display panel may include a plurality of gate lines, a plurality of data lines, and a plurality of pixels respectively provided in a plurality of pixel areas defined by intersections of the gate lines and the data lines. Also, the display panel may include an array substrate including a TFT, which is an element for selectively applying a voltage to each of the pixels, an organic light emitting device layer on the array substrate, and an encapsulation substrate disposed on the array substrate to cover the organic light emitting device layer. The encapsulation substrate may protect the TFT and the organic light emitting device layer from an external impact and may prevent or reduce water or oxygen from penetrating into the organic light emitting device layer. Also, a layer provided on the array substrate may include an inorganic light emitting layer (for example, a nano-sized material layer, a quantum dot, or the like).

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

Figure 2:
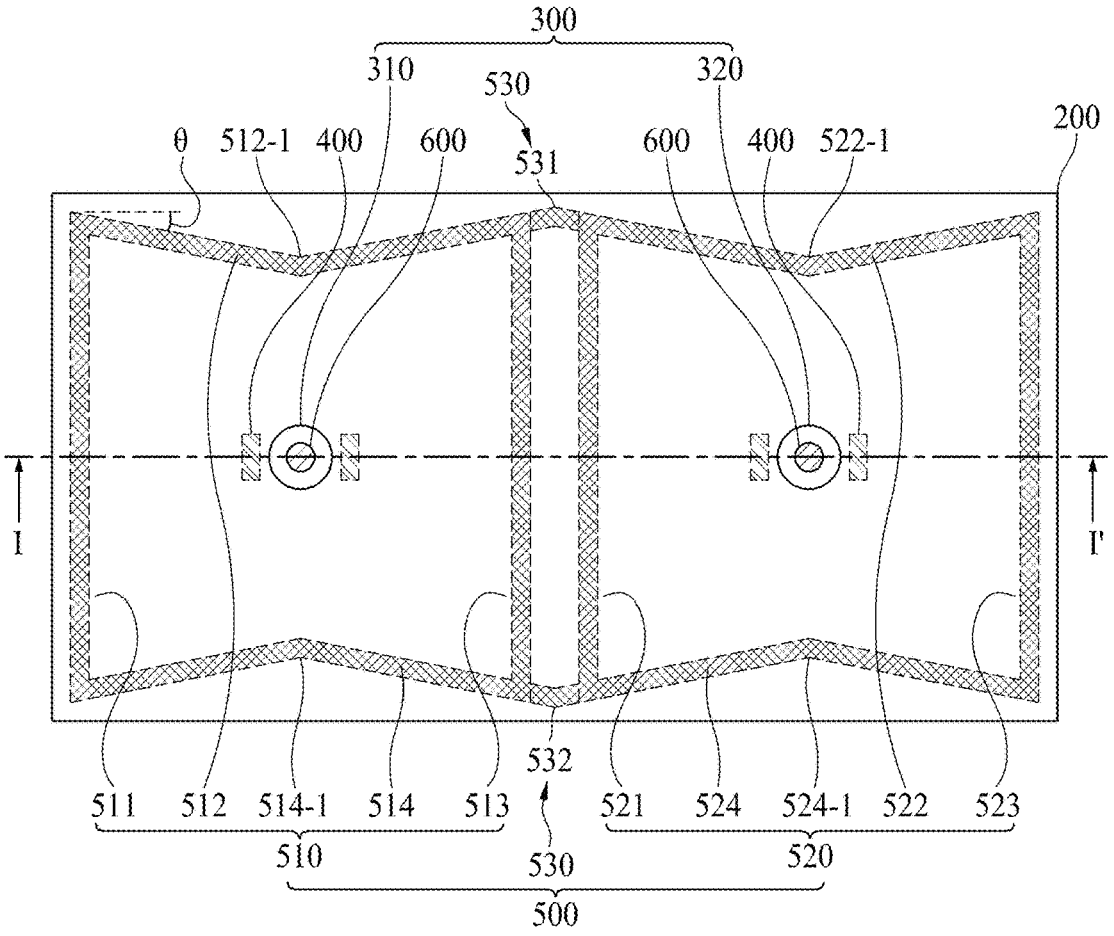
FIG. 2 is a rear view of a display apparatus according to a first embodiment of the present disclosure.
Figure 3:
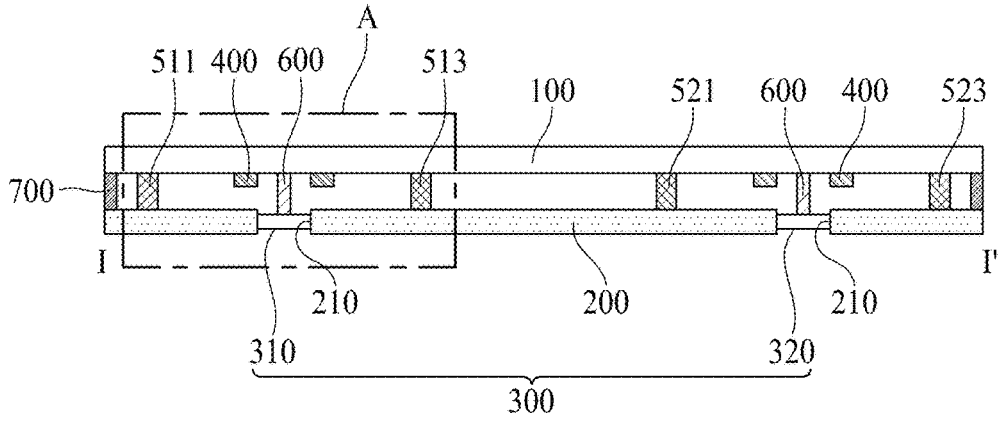
FIG. 3 is a cross-sectional view taken along line I-I' of FIG. 2.
Figure 4A:
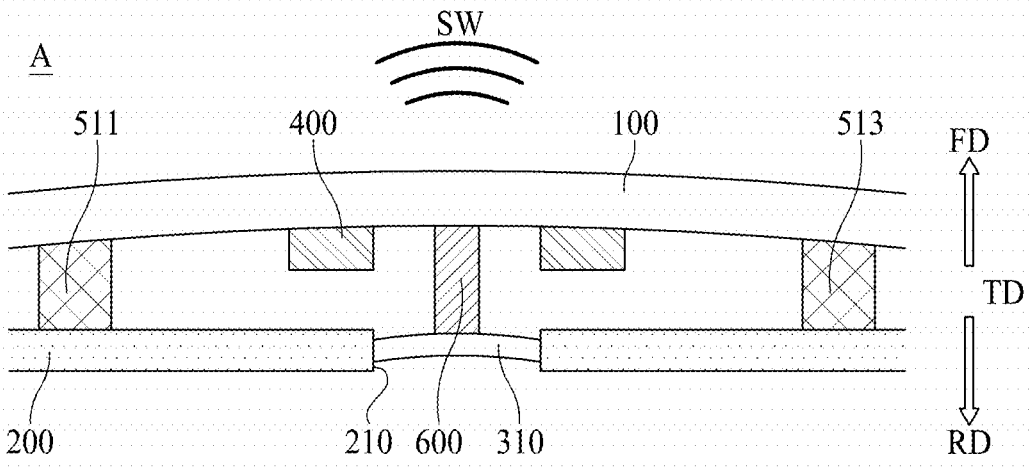
FIGS. 4A and 4B are diagrams illustrating a display panel vibrated by a vibration generating device in region A of FIG. 3.
Figure 4B:
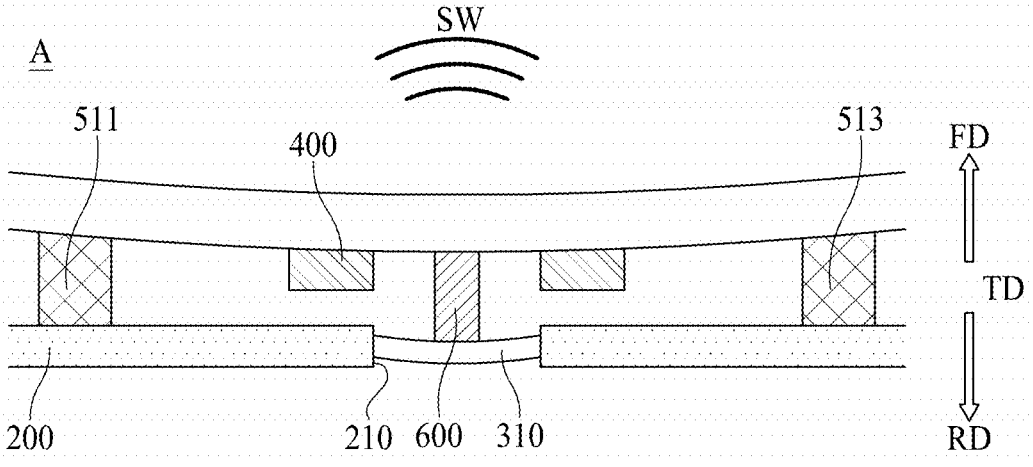
Figure 5:
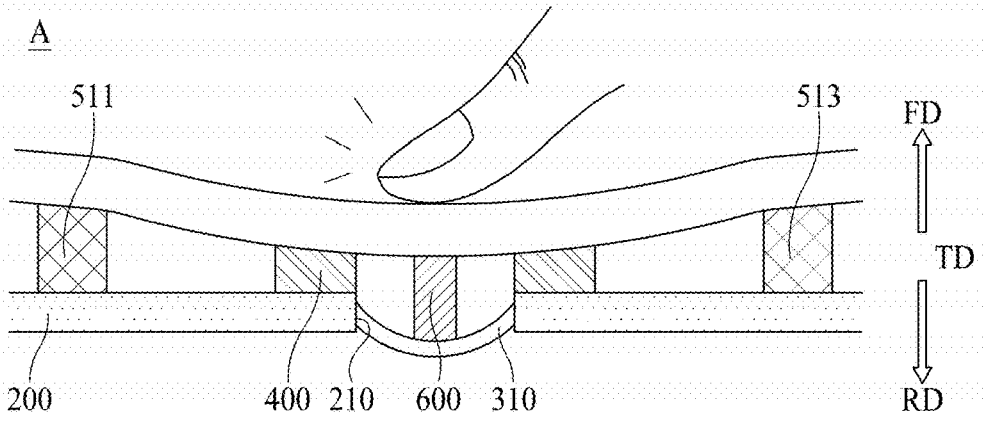
FIG. 5 is a diagram illustrating a display apparatus to which an external impact is applied in region A of FIG. 3.

FIG. 1 is a perspective view of a display apparatus according to an embodiment of the present disclosure. FIG. 2 is a rear view of a display apparatus according to a first embodiment of the present disclosure. FIG. 3 is a cross-sectional view taken along line I-I' of FIG. 2. FIGS. 4A and 4B are diagrams illustrating a display panel vibrated by a vibration generating device in region A of FIG. 3. FIG. 5 is a diagram illustrating a display apparatus to which an external impact is applied in region A of FIG. 3.

With reference to FIGS. 1 to 5, the display apparatus may include a display panel 100, a rear structure 200, a vibration generating device 300, a buffer member 400, a partition member 500, a vibration transfer member 600, and an adhesive member 700.

The display panel 100 may display an image and may be implemented as any type of display panel, such as a liquid crystal display panel, an organic light emitting diode (OLED) display panel, an electroluminescent display panel, etc. The display panel 100 may vibrate according to a vibration of the vibration generation device 200 to output sound.

The display panel 100 may include a pixel array which displays an image on the basis of image data. In the pixel array, a plurality of data lines may intersect a plurality of gate lines, and a plurality of pixels may be arranged as a matrix type. Each of the plurality of pixels may include a red subpixel, green subpixel, and a blue subpixel, for implementing colors. Also, each of the plurality of pixels may further include a white subpixel.

The rear structure 200 may be disposed on a rear surface of the display panel 100 to support the display panel 100. Here, a front surface of the display panel 100 may correspond to a surface that displays an image, and the rear surface of the display panel 100 may correspond to an opposite surface with respect to the front surface. For example, the rear structure 200 may be disposed apart from the display panel 100 to support the vibration generating device 300 disposed in the rear structure 200.

The rear structure 200 may cover the whole rear surface of the display panel 100 to be spaced apart from the whole rear surface, have a plate shape, and include a glass, a metal material, or a plastic material. Here, an edge or a sharp corner of the rear structure 200 may have a tetragonal shape or a curved shape through a chamfer process or a corner rounding process. According to an embodiment, the rear structure 200 including the glass material may have sapphire glass. For example, the rear structure 200 including the metal material may be formed of one of aluminum (Al), an Al alloy, a magnesium (Mg) alloy, and an alloy of iron (Fe) and nickel (Ni). As another example, the rear structure 200 may have a stacked structure also including a glass plate, which has a thickness relatively thinner than the metal plate, and faces the rear surface of the display panel 100. In this case, a rear surface of the display apparatus may be used as a mirror surface due to the metal plate.

The rear structure 200 may include a through hole 210 into which the vibration generating device 300 is inserted. For the vibration generating device 300 to be inserted into the through hole 210, the through hole 210 having a circular shape or a polygonal shape may be bored in a partial region of the rear structure 200 along a thickness direction of the rear structure 200.

The vibration generating device 300 may be inserted into a through hole 210 and may vibrate the display panel 100. The vibration generating device 300 may be fixed to the rear structure 200 to vibrate and may transfer the vibration to the display panel 100 through the vibration transfer member 600. Therefore, the vibration generating device 300 may vibrate based on a vibration signal corresponding to a sound signal associated with an image using the rear structure 200 as a supporter to vibrate the vibration transfer member 600, and the display panel 100 may be provided with the vibration of the vibration transfer member 600 to output a sound SW to a forward direction FD. Therefore, using the display panel 100 vibrating through the vibration transfer member 600 as a vibration plate of a sound device, the display apparatus may output a sound to the forward direction FD instead of a rearward direction RD behind the display panel 100 and a region under the display panel 100 and may allow an output position of an image displayed by the display apparatus to match an output position of a sound generated by the display apparatus, thereby enhancing an immersion experience of a viewer who is watching the image displayed by the display apparatus.

The vibration generating device 300 may be inserted into the through hole 210 of the rear structure 200 and may be disposed not to protrude to a front surface or a rear surface of the rear structure 200. Because the vibration generating device 300 does not protrude to the front surface or the rear surface of the rear structure 200, a thickness of the display apparatus may be reduced. The vibration generating device 300 may include piezopolymer including at least one of polyvinylidene fluoride (PVDF) homopolymer, PVDF copolymer, PVDF terpolymer, cyano-polymer, cyano-copolymer, and boron (BN) polymer, but is not limited thereto. Here, examples of the PVDF copolymer may include PVDF-TrFE, PVDF-TFE, PVDF-CTFE, and PVDF-CFE, but the present embodiment is not limited thereto. Also, examples of the PVDF copolymer may include PVDF-TrFe-CFE and PVDF-TrFE-CTFE, but the present embodiment is not limited thereto. Also, examples of the PVDF copolymer may include PVDCN-vinyl acetate and PVDCN-vinyl propionate, but the present embodiment is not limited thereto. Also, examples of the BN polymer may include polyaminoboran and polyaminodifluoroboran, but the present embodiment is not limited thereto.

According to an embodiment, the display apparatus may further include a cover member (not shown) which covers a rear surface of the vibration generating device 300. In this case, the cover member may not protrude to the rear surface of the rear structure 200, but is not limited thereto.

According to an embodiment, the vibration generating device 300 may include first and second sound generating modules 310 and 320 which vibrate different regions of the display panel 100. For example, the first and second sound generating modules 310 and 320 may be fixed through the rear structure 200 and may be disposed apart from each other. For example, the display panel 100 may include a left region and a right region, the first sound generating module 310 may overlap the left region of the display panel 100, and the second sound generating module 320 may overlap the right region of the display panel 100. Therefore, the first sound generation device 310 may be disposed on a left side of the rear surface of the display panel 100 to vibrate the left region of the display panel 100, and the second sound generation device 320 may be disposed on a right side of the rear surface of the display panel 100 to vibrate the right region of the display panel 100. The first and second sound generating modules 310 and 320 may receive different vibration signals and may be independently driven. For example, the first sound generating module 310 may generate a sound by using the left region of the display panel 110 as a vibration plate, and the second sound generating module 320 may generate a sound using the right region of the display panel 110 as a vibration plate.

According to an embodiment, the vibration generating device 300 may be a speaker, and for example, may be a sound actuator, a sound exciter, or a piezoelectric element, but is not limited thereto. In other embodiments, the vibration generating device 300 may be a sound device for outputting a sound according to an electrical signal.

The buffer member 400 may be attached on the display panel 100 and may define or limit a maximum displacement of the vibration generating device 300. The buffer member 400 may be attached on one surface of the display panel 100 facing the rear structure 200 and may surround the vibration transfer member 600 spaced apart from the buffer member 400. For example, the buffer member 400 may be attached on the rear surface of the display panel 100. Here, the front surface of the display panel 100 may correspond to a surface that displays an image, and the rear surface of the display panel 100 may correspond to an opposite surface with respect to the front surface.

The buffer member 400 may not overlap the through hole 210 of the rear structure 200, but may be disposed in a region adjacent to the through hole 210. According to an embodiment, the buffer member 400 may be disposed maximally adjacent to the through hole 210 and maximally apart from the partition member 500. For example, the buffer member 400 may be attached on the display panel 100 and spaced apart from the rear structure 200 and the partition member 500 may be disposed between the display panel 100 and the rear structure 200. Thus, if the buffer member 400 is positioned farther away from the partition member 500, the buffer member 400 may define or limit a maximum displacement of the vibration generating device 300 inserted into the through hole 210 when an external impact occurs.

According to an embodiment, the buffer member 400 may be provided in plurality, and adjacent buffer members 400 may be disposed symmetrically with respect to the vibration transfer member 600. For example, adjacent buffer members 400 may be disposed symmetrically with respect to the vibration transfer member 600 as in left and right portions and upper, lower, left, and right portions of the vibration transfer member 600. The vibration transfer member 600 may overlap a center portion of the through hole 210 or the sound generating module 310, and the buffer member 400 may be disposed adjacent to the through hole 210 or the sound generating module 310, whereby the buffer member 400 may surround the vibration transfer member 600 to be spaced apart from the vibration transfer member 600.

A thickness of the buffer member 400 may be less than that of the partition member 500 disposed between the display panel 100 and the rear structure 200. Here, a thickness of each of the buffer member 400 and the partition member 500 may be measured in the same direction as a thickness of each of the display panel 100 and the rear structure 200. According to an embodiment, when the vibration generating device 300 vibrates the display panel 100, the buffer member 400 may be separated from the rear structure 200, and when an external impact is applied to the display panel 100, the buffer member 400 may contact the rear structure 200. A height of the partition member 500 disposed between the display panel 100 and the rear structure 200 may be higher in position than a height of the buffer member 400 attached on the rear surface of the display panel 100. Also, a displacement caused by a vibration of the display panel 100 may be less than a distance between the buffer member 400 and the rear structure 200.

For example, as shown in FIGS. 4A and 4B, when the vibration generating device 300 vibrates the display panel 100 through the vibration transfer member 600 to output a sound SW, the buffer member 400 attached on the display panel 100 may vibrate as one body with the display panel 100. At this time, because a displacement caused by the vibration of the display panel 100 is less than a distance between the buffer member 400 and the rear structure 200, the buffer member 400 may not contact the rear structure 200 even when the buffer member 400 vibrates as one body with the display panel 100.

However, as shown in FIG. 5, when an external impact is applied to the display panel 100, a displacement of the display panel 100 may increase as compared to a displacement caused by a vibration, and the buffer member 400 may contact the rear structure 200 to define or limit a maximum displacement of the vibration generating device 300. For example, when an external impact is applied to a display apparatus that does not include the buffer member 400, the external impact may be transferred to the vibration generating device 300, causing damage of the vibration generating device 300. Accordingly, even when an external impact is applied to the display panel 100, the buffer member 400 may maximally define or limit a maximum displacement of the vibration generating device 300, thereby preventing or reducing the vibration generating device 300 from being damaged or broken down.

According to an embodiment, the buffer member 400 may have an elastic force that is higher than that of the partition member 500. For example, the partition member 500 may be disposed between the display panel 100 and the rear structure 200 to prevent or reduce interference between sounds generated by the plurality of sound generating modules 310 and 320, and the buffer member 400 may be attached on the rear surface of the display panel 100 to define or limit a maximum displacement of the vibration generating device 300 when an external impact is applied to the display panel 100. Accordingly, if the buffer member 400 is provided farther away from the partition member 500, the maximum displacement of the vibration generating device 300 inserted into the through hole 210 may be limited when an external impact occurs.

According to an embodiment, the buffer member 400 may have an elastic force that is higher than that of the vibration transfer member 600. For example, the vibration transfer member 600 may be disposed between the display panel 100 and the vibration generating device 300 to transfer a vibration generated by the vibration generating device 300 to the display panel 100, and the buffer member 400 may be attached on the rear surface of the display panel 100 to define or limit the maximum displacement of the vibration generating device 300 when an external impact is applied to the display panel 100. Accordingly, the buffer member 400 may prevent or reduce an external impact applied to the display panel 100 from being transferred to the vibration generating device 300 through the vibration transfer member 600. Thus, the maximum displacement of the vibration generating device 300 inserted into the through hole 210 may be limited.

The partition member 500 may be disposed between the display panel 100 and the rear structure 200 and may surround the sound generating modules 310 and 320 spaced apart from the partition member 500. The partition member 500 may prevent or reduce sounds generated by the sound generating modules 310 and 320 from being leaked and may allow a sound SW to be output to only the forward direction FD in front of the display panel 100, thereby enhancing a sound output characteristic.

According to an embodiment, the partition member 500 may include first to third partition members 510 to 530. The display panel 100 may include a left region, a right region, and a middle region, and the first partition member 510 may surround the left region of the display panel 100, the second partition member 520 may surround the right region of the display panel 100, and the third partition member 530 may surround the middle region of the display panel 100. For example, the first partition member 510 or the second partition member 520 may be disposed along four sides of an outer portion of the left region or the right region of the display panel 100, and the third partition member 530 may be disposed between the first partition member 510 and the second partition member 520. Each of the first to third partition members 510 to 530 may prevent or reduce a sound from being leaked through each side surface of the display panel 100 and may allow the sound SW to be output to only the forward direction FD in front of the display panel 100, thereby enhancing a sound output characteristic.

The first and second partition members 510 and 520 may each include four sides, and the third partition member 530 may include two sides. For example, the first partition member 510 may include first to fourth sides 511 to 514, the second partition member 520 may include first to fourth sides 521 to 524, and the third partition member 530 may include first and second sides 531 and 532. The first and second sides 531 and 532 of the third partition member 530 may have a broken shape, as shown in FIG. 2, or may have a rectilinear shape or a round shape, but is not limited thereto. Here, the first to fourth sides 511 to 514 of the first partition member 510 and the first to fourth sides 521 to 524 of the second partition member 520 have a difference in that the first to fourth sides 511 to 514 of the first partition member 510 or the first to fourth sides 521 to 524 of the second partition member 520 are disposed in the left region or the right region of the display panel 100, and thus, a description of the same or similar technical feature of each of the first to fourth sides 521 to 524 of the second partition member 520 as that of each of the first to fourth sides 511 to 514 of the first partition member 510 is omitted.

According to an embodiment, the partition member 500 may include a bent portion which is provided in at least one of four sides thereof. For example, the second side 512 and the fourth side 514 of the first partition member 510 may respectively include a bent portion 512-1 and a bent portion 514-1. Therefore, two sides 512 and 514, respectively disposed on upper and lower portions, of four sides surrounding the left region of the display panel 100 may each include a bent portion which is provided to have a certain inclined angle "θ" with respect to a horizontal direction (or a widthwise direction) of the display panel 100. The bent portion 512-1 may be configured with two rectilinear parts and may be provided at a position at which the two rectilinear parts contacts each other. Also, the bent portion 512-1 may be configured in a rectilinear shape, a curve shape, or a round shape, but is not limited thereto.

According to an embodiment, an inclined angle "θ" of the bent portion 512-1 may be formed based on a degree to which restriction of a standing wave is desired, and may be variably adjusted to 10 degrees to 30 degrees. For example, if a sound output region is for a low sound band or an output of a sound generating module is large, the inclined angle "θ" of the bent portion 512-1 may be adjusted to a large angle. Alternatively, if the sound output region is for the high sound band or the output of the sound generating device is small, the inclined angle "θ" of the bent portion 512-1 may be adjusted to a small angle.

According to an embodiment, the bent portion 512-1 may prevent a sound pressure from being reduced between the display panel 100 and the rear structure 200. For example, a sound wave which is generated when the display panel 100 is vibrated by the vibration generating device 300 may be spread radially from a center of the vibration generating device 300 and may travel. The sound wave may be referred to as a progressive wave. The progressive wave may be reflected by one side of the partition member 500 to generate a reflected wave, and the reflected wave may travel in a direction opposite to the progressive wave. The reflected wave overlaps and interferes in the progressive wave and does not travel, thereby generating a standing wave which stands at a certain position. A sound pressure is reduced by the standing wave, and for this reason, a sound output characteristic is reduced. Therefore, a bent portion may be provided in the partition member 500 in order to decrease the degree of reduction in sound pressure caused by the standing wave generated by interference between the reflected wave and the progressive wave. Also, the standing wave that causes the sound pressure to be reduced is much generated at a position at which a level of each of the progressive wave and the reflected wave is high. Accordingly, the bent portion 512-1 may be disposed at a position at which a level of a sound wave transferred from a vibration generating module is highest. According to an embodiment, the bent portion 512-1 may be bent toward the vibration generating device 300.

According to an embodiment, each of the first to third partition members 510 to 530 may be implemented with a double-sided tape or a single-sided tape, which includes polyurethane or polyolefin and has a certain thickness (or height) and a certain width, but is not limited thereto. Also, each of the first to third partition members 510 to 530 may have an elastic force which enables compression to be made to a certain degree, and may be referred to as an enclosure or a baffle.

The vibration transfer module 600 may be disposed between the display panel 100 and the vibration generating device 300. The vibration transfer member 600 may transfer a vibration generated by the vibration generating device 300 to the display panel 100. For example, the vibration generated by the vibration generating device 300 may be rectilinearly transferred through the vibration transfer member 600 and the display panel 100, and thus, the sound SW may be output to the forward direction FD in front of the display panel 100. Therefore, the vibration transfer member 600 may transfer the vibration, generated by the vibration generating device 300 spaced apart from the display panel 100, to the display panel 100. In other words, in the display apparatus according to the present disclosure, instead of directly attaching the vibration generating device 300 to the display panel 100, the vibration generating device 300 may be connected to the display panel 100 through the vibration transfer member 600, thereby securing the reliability of the vibration generating device 300. In this case, the vibration transfer member 600 may include a material that has good vibration transfer characteristic and may guide a vibration transfer direction, thereby minimizing the loss of a sound pressure level. Accordingly, the vibration transfer member 600 may transfer the vibration generated by the vibration generating device 300 to the display panel 100 and may prevent a sound pressure level from being reduced, thereby enhancing flatness of a sound pressure level corresponding to a whole frequency domain and enhancing clarity of a sound.

According to an embodiment, the vibration transfer member 600 may include a material which is high in elasticity, and thus, may be implemented to have a vibration transfer characteristic that is better than that of each of the display panel 100 and the rear structure 200. For example, the vibration transfer member 600 may include metal, such as Al, copper (Cu), or stainless steel having an excellent vibration transfer characteristic, or may include a tempered plastic compound. Therefore, because the vibration transfer member 600 is implemented to have a vibration transfer characteristic that is better than that of each of the display panel 100 and the rear structure 200, the vibration transfer member 600 may induce a path of the vibration generated by the vibration generating device 300 and may prevent the reduction in a sound pressure level output to the forward region in front of the display panel 100. Also, the vibration transfer member 600 may enhance flatness of a sound pressure level corresponding to a whole frequency domain.

The adhesive member 700 may be disposed between an edge of the display panel 100 and an edge of the rear structure 200 and may attach the display panel 100 on the rear structure 200. The adhesive member 700 may be disposed between the display panel 100 and the rear structure 200 to have a certain thickness (or height) and may have a sealing structure having a four-side-sealed type or a closed loop type. The adhesive member 700 may be provided between a rear edge of the display panel 100 and a front edge of the rear structure 200 and may couple the rear structure 200 to the rear surface of the display panel 100, thereby maintaining a gap space between the rear surface of the display panel 100 and a front surface of the rear structure 200. Here, the gap space may be used as a space for a vibration of the display panel 100 caused by driving of the vibration generating device 300. Also, the gap space provided between the display panel 100 and the rear structure 200 prevents or reduces light irradiated onto the display panel 100 from non-uniformly concentrating on a specific position, thereby enhancing the light luminance uniformity of the display apparatus.

According to an embodiment, the adhesive member 700 may include a foam pad including an acryl-based material and an adhesive layer provided on each of a front surface and a rear surface of the foam pad. According to an embodiment, the adhesive member 700 may include an optically clear resin (OCR), an optically clear adhesive (OCA), a double-sided tape, and/or the like.

Figure 6:
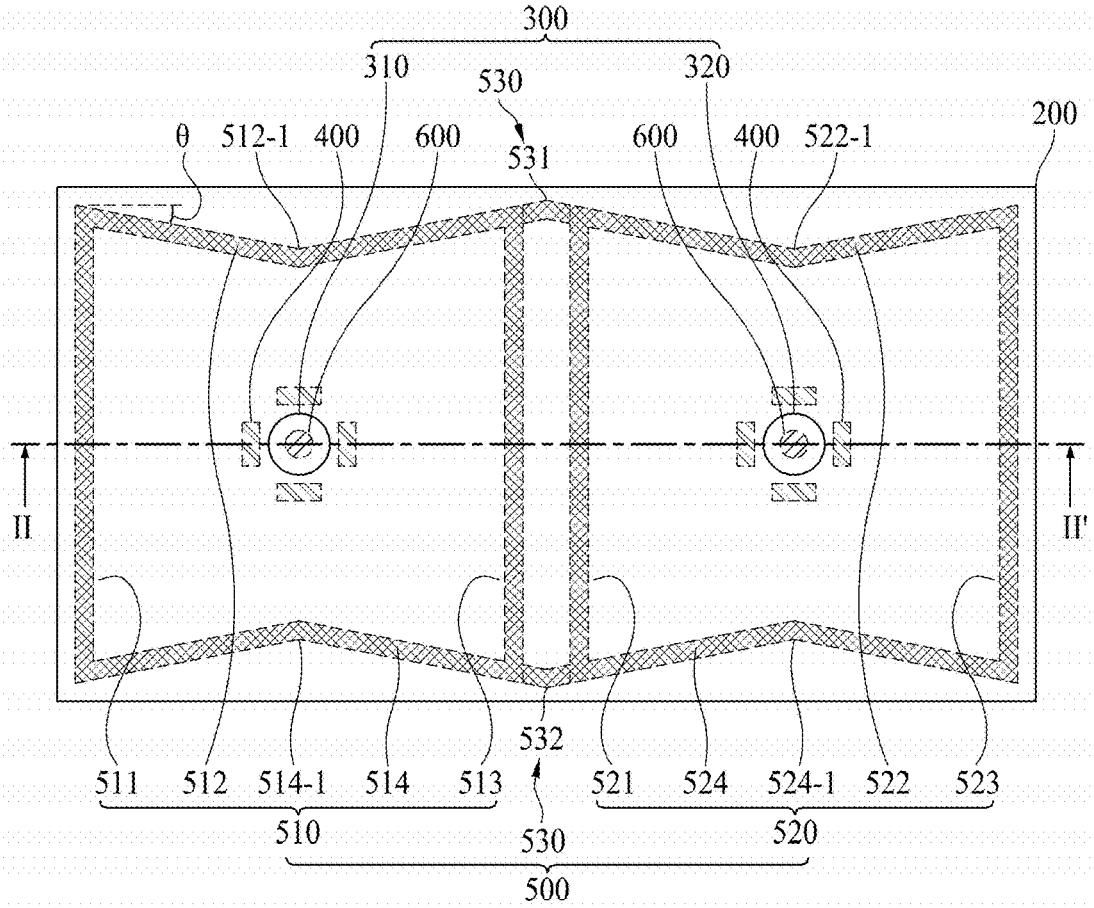
FIG. 6 is a rear view of a display apparatus according to a second embodiment of the present disclosure.
Figure 7:
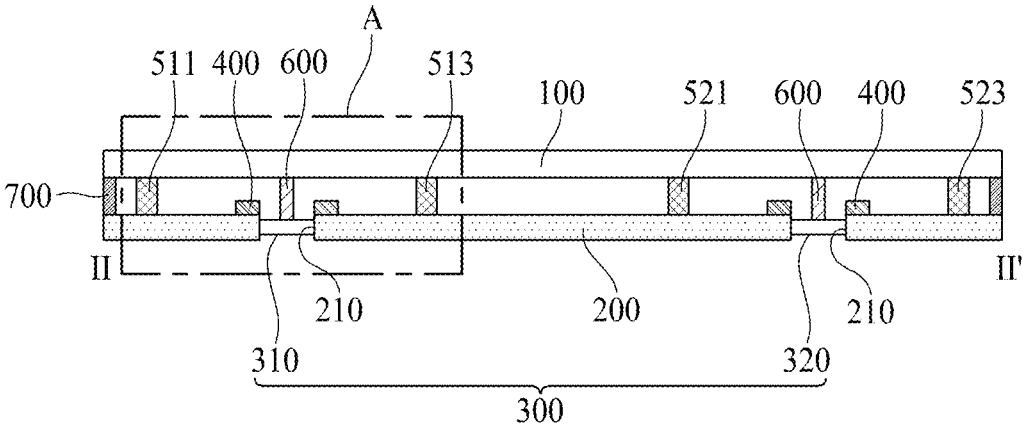
FIG. 7 is a cross-sectional view taken along line II-IF of FIG. 6.
Figure 8A:
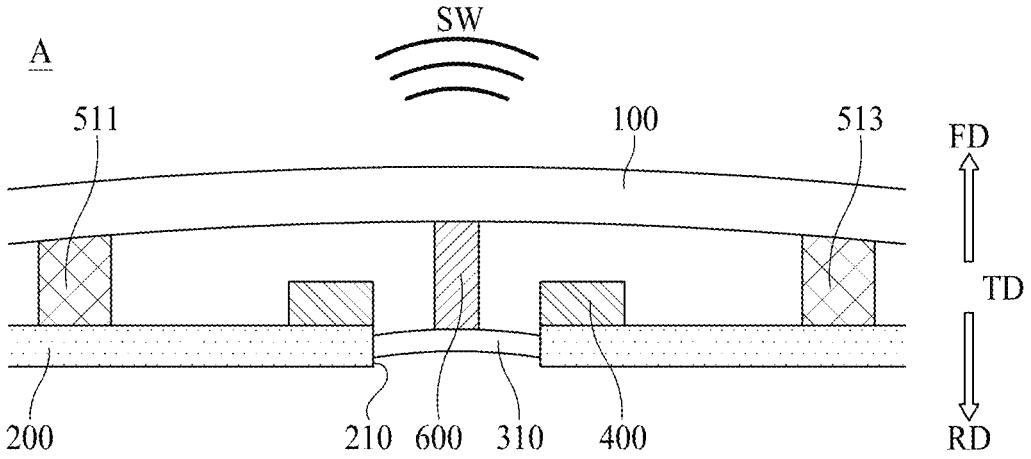
FIGS. 8A and 8B are diagrams illustrating a display panel vibrated by a vibration generating device in region A of FIG. 7.
Figure 8B:
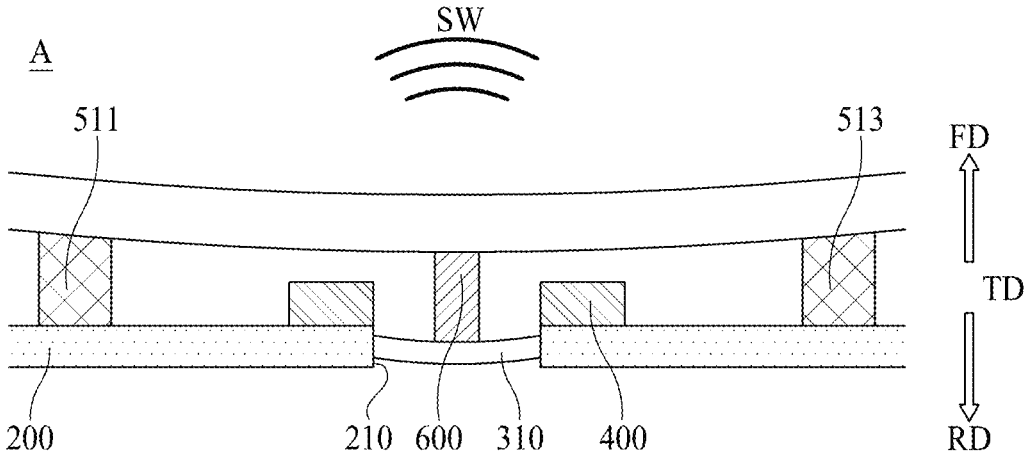
Figure 9:
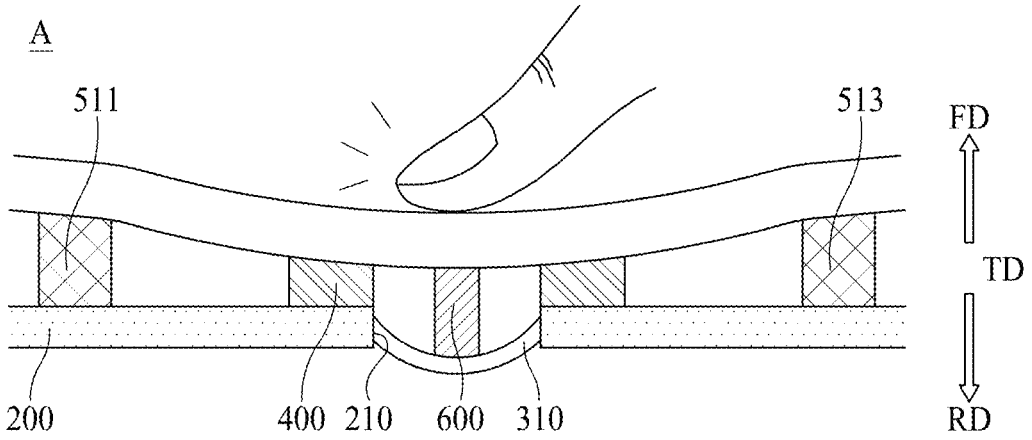
FIG. 9 is a diagram illustrating a display apparatus to which an external impact is applied in region A of FIG. 7.

FIG. 6 is a rear view of a display apparatus according to a second embodiment of the present disclosure. FIG. 7 is a cross-sectional view taken along line II-II' of FIG. 6. FIGS. 8A and 8B are diagrams illustrating a display panel vibrated by a vibration generating device in region A of FIG. 7. FIG. 9 is a diagram illustrating a display apparatus to which an external impact is applied in region A of FIG. 7. Here, at least a buffer member 400 may be modified. The same or similar elements as the above-described elements will be briefly described or are not described.

With reference to FIGS. 6 to 9, a buffer member 400 may be attached to a rear structure 200 and may define or limit a maximum displacement of a vibration generating device 300. The buffer member 400 may be attached on one surface of the rear structure 200 facing a display panel 100 and may surround the vibration transfer member 600 spaced apart from the buffer member 400. For example, the buffer member 400 may be attached on a front surface of the rear structure 200. Here, the front surface of the rear structure 200 may correspond to the one surface facing the display panel 100.

The buffer member 400 may be disposed in a region adjacent to a through hole 210 of the rear structure 200. The buffer member 400 may be disposed adjacent to the through hole 210 and apart from a partition member 500. For example, the buffer member 400 may be attached on the rear structure 200 and spaced apart from the display panel 100 and the partition member 500 may be disposed between the display panel 100 and the rear structure 200. Thus, if the buffer member 400 is provided farther away from the partition member 500, the buffer member 400 may define or limit a maximum displacement of the vibration generating device 300 inserted into the through hole 210 when an external impact occurs.

According to an embodiment, the buffer member 400 may be provided in plurality, and adjacent buffer members 400 may be disposed symmetrically with respect to the vibration transfer member 600. For example, adjacent buffer members 400 may be disposed symmetrically with respect to the vibration transfer member 600 as in left and right portions and upper, lower, left, and right portions of the vibration transfer member 600. The vibration transfer member 600 may overlap a center portion of the through hole 210 or a sound generating module 310, and the buffer member 400 may be disposed adjacent to the through hole 210 or the sound generating module 310, whereby the buffer member 400 may surround the vibration transfer member 600 to be spaced apart from the vibration transfer member 600.

A thickness of the buffer member 400 may be less than that of the partition member 500 disposed between the display panel 100 and the rear structure 200. Here, a thickness of each of the buffer member 400 and the partition member 500 may be measured in the same direction as a thickness of each of the display panel 100 and the rear structure 200. According to an embodiment, when the vibration generating device 300 vibrates the display panel 100, the buffer member 400 may be separated from the display panel 100, and when an external impact is applied to the display panel 100, the buffer member 400 may contact the display panel 100. A height of the partition member 500 disposed between the display panel 100 and the rear structure 200 may be higher in position than a height of the buffer member 400 attached on a rear surface of the display panel 100. Also, a displacement caused by a vibration of the display panel 100 may be less than a distance between the buffer member 400 and the rear structure 200.

For example, as shown in FIGS. 8A and 8B, the vibration generating device 300 may vibrate the display panel 100 through the vibration transfer member 600 to output a sound SW. At this time, because a displacement caused by the vibration of the display panel 100 is less than a distance between the buffer member 400 and the rear structure 200, the buffer member 400 may not contact the display panel 100 even when the display panel 100 vibrates to output the sound SW.

However, as shown in FIG. 9, when an external impact is applied to the display panel 100, a displacement of the display panel 100 may increase as compared to a displacement caused by a vibration, and the buffer member 400 may contact the display panel 100 to define or limit a maximum displacement of the vibration generating device 300. For example, when an external impact is applied to a display apparatus that does not include the buffer member 400, the external impact may be transferred to the vibration generating device 300, causing damage of the vibration generating device 300. Accordingly, even when an external impact is applied to the display panel 100, the buffer member 400 may define or limit a maximum displacement of the vibration generating device 300, thereby preventing or reducing the vibration generating device 300 from being damaged or broken down.

According to an embodiment, the buffer member 400 may have an elastic force that is higher than that of the partition member 500. For example, the partition member 500 may be disposed between the display panel 100 and the rear structure 200 to prevent or reduce interference between sounds generated by a plurality of sound generating modules 310 and 320, and the buffer member 400 may be attached on a front surface of the rear structure 200 to define or limit a maximum displacement of the vibration generating device 300 when an external impact is applied to the display panel 100. Accordingly, if the buffer member 400 is provided farther away from the partition member 500, the maximum displacement of the vibration generating device 300 inserted into the through hole 210 may be limited when an external impact occurs.

According to an embodiment, the buffer member 400 may have an elastic force that is higher than that of the partition member 500. For example, the partition member 500 may be disposed between the display panel 100 and the rear structure 200 to prevent interference between sounds generated by the plurality of sound generating modules 310 and 320, and the buffer member 400 may be attached on a front surface of the rear structure 200 to define or limit a maximum displacement of the vibration generating device 300 when an external impact is applied to the display panel 100. Thus, the buffer member 400 may prevent or reduce an external impact applied to the display panel 100 from being transferred to the vibration generating device 300 through the vibration transfer member 600. Further, the maximum displacement of the vibration generating device 300 inserted into the through hole 210 may be defined or limited using the buffer member 400.

Figure 10:
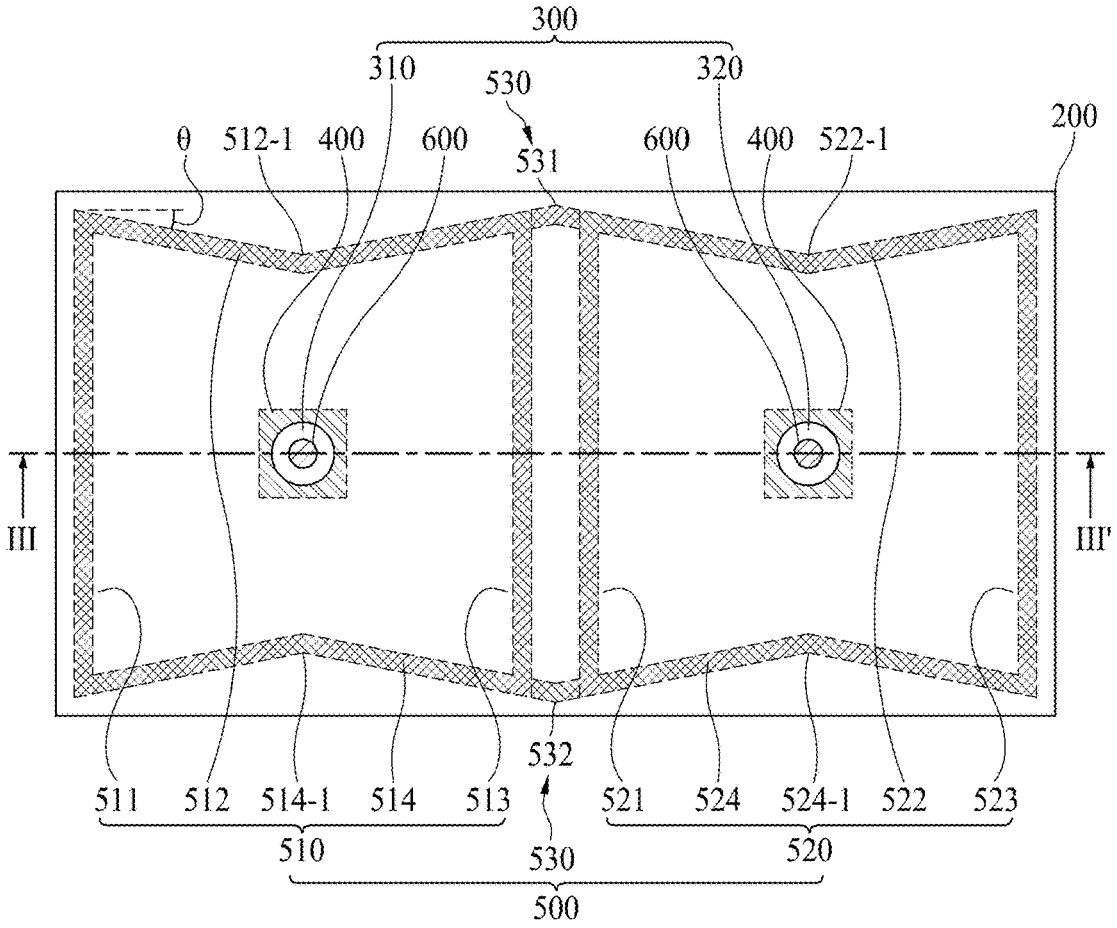
FIG. 10 is a rear view of a display apparatus according to a third embodiment of the present disclosure.
Figure 11:
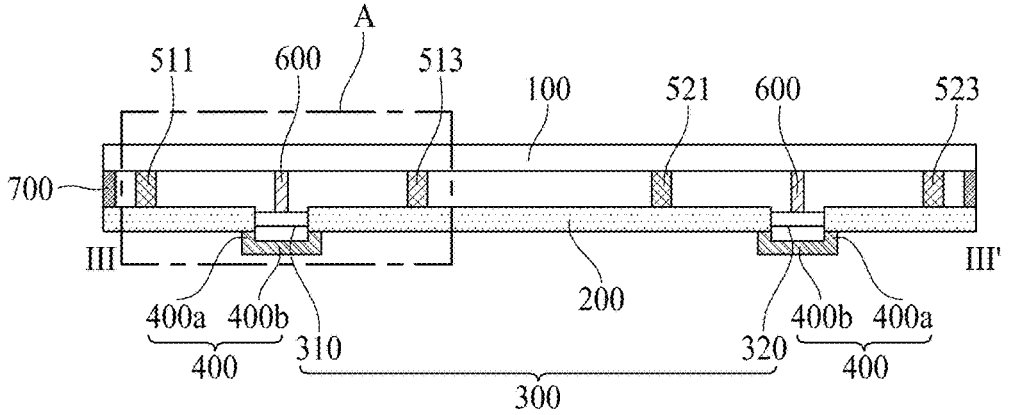
FIG. 11 is a cross-sectional view taken along line III-III' of FIG. 10.
Figure 12A:
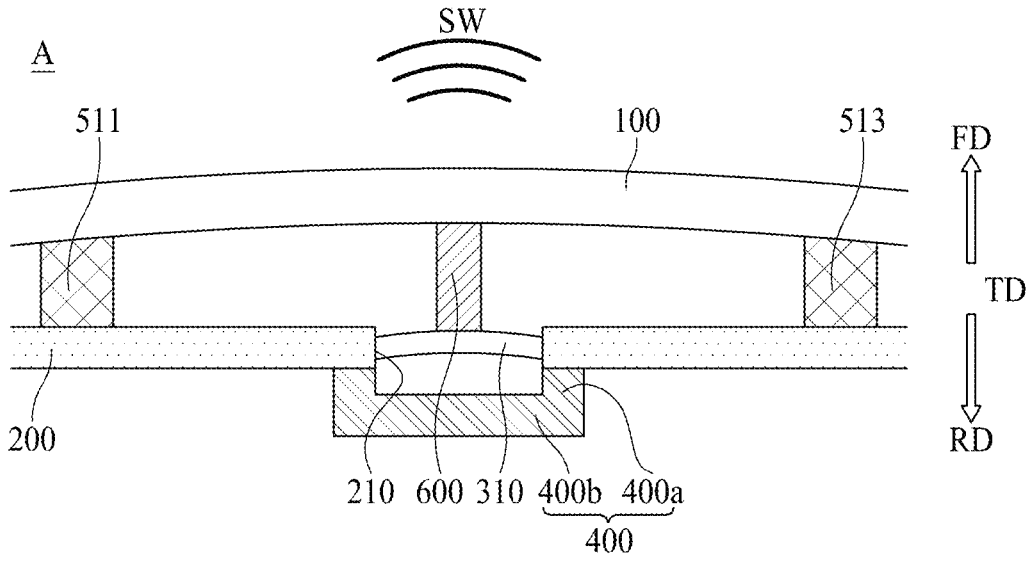
FIGS. 12A and 12B are diagrams illustrating a display panel vibrated by a vibration generating device in region A of FIG. 11.
Figure 12B:
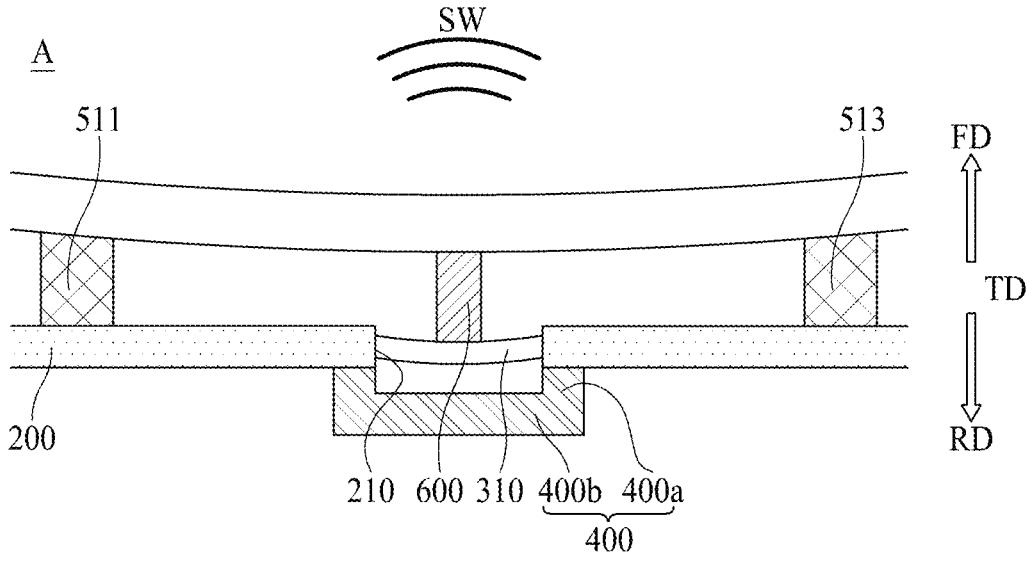
Figure 13:
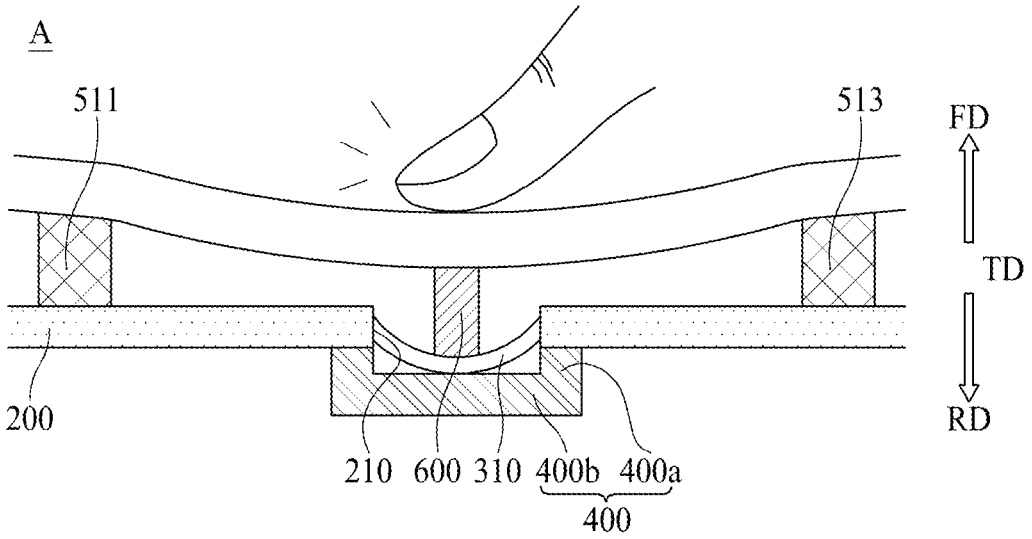
FIG. 13 is a diagram illustrating a display apparatus to which an external impact is applied in region A of FIG. 11.

FIG. 10 is a rear view of a display apparatus according to a third embodiment of the present disclosure. FIG. 11 is a cross-sectional view taken along line III-III' of FIG. 10. FIGS. 12A and 12B are diagrams illustrating a display panel vibrated by a vibration generating device in region A of FIG. 11. FIG. 13 is a diagram illustrating a display apparatus to which an external impact is applied in region A of FIG. 11. Here, at least a buffer member 400 may be modified. The same or similar elements as the above-described elements will be briefly described or are not described.

With reference to FIGS. 10 to 13, a buffer member 400 may be attached on a rear structure 200 and may define or limit a maximum displacement of a vibration generating device 300. The buffer member 400 may be attached on the other surface opposite to one surface of the rear structure 200 facing a display panel 100 and may be disposed to overlap each of a through hole 210, the vibration generating device 300, and the vibration transfer member 600. For example, the buffer member 400 may be attached to a rear surface of the rear structure 200. Here, the rear surface of the rear structure 200 may correspond to the other surface opposite to the one surface facing the display panel 100.

According to an embodiment, the buffer member 400 may include a vertical portion 400*a* and a horizontal portion 400*b*. The vertical portion 400*a* of the buffer member 400 may be attached on the rear surface of the rear structure 200. The vertical portion 400*a* may be disposed in a region adjacent to the through hole 210 to support the vertical portion 400*a* overlapping the through hole 210. For example, the vertical portion 400*a* may extend from the rear surface of the rear structure 200 to a rearward region behind the display apparatus to support the horizontal portion 400*b*.

The horizontal portion 400*b* of the buffer member 400 may overlap the through hole 210 and the vibration generating device 300 and may be disposed in parallel with the vibration generating device 300. The horizontal portion 400*b* may be disposed in parallel with the vibration generating device 300. Thus, when an external impact is applied to the display panel 100, the horizontal portion 400*b* may directly contact the vibration generating device 300 to define or limit a maximum displacement of the vibration generating device 300.

The horizontal portion 400*b* of the buffer member 400 may be disposed to overlap the vibration transfer member 600. For example, the vibration transfer member 600 may be connected to a front surface of the vibration generating device 300, and the horizontal portion 400*b* of the buffer member 400 may be spaced apart from a rear surface of the vibration generating device 300 by a certain distance.

A distance between the horizontal portion 400*b* of the buffer member 400 and the vibration generating device 300 may be less than a thickness of the partition member 500 disposed between the display panel 100 and the rear structure 200. Here, a thickness of each of the buffer member 400 and the partition member 500 may be measured in the same direction as a thickness of each of the display panel 100 and the rear structure 200. When the vibration generating device 300 vibrates the display panel 100, the horizontal portion 400*b* of the buffer member 400 may be separated from the display panel 100, and when an external impact is applied to the display panel 100, the horizontal portion 400*b* of the buffer member 400 may contact the vibration generating device 300. A height of the partition member 500 disposed between the display panel 100 and the rear structure 200 may be higher in position than a height of the vertical portion 400*a* of the buffer member 400. Also, a displacement caused by a vibration of the display panel 100 may be less than a distance between the horizontal portion 400*b* of the buffer member 400 and the vibration generating device 300.

For example, as shown in FIGS. 12A and 12B, the vibration generating device 300 may vibrate the display panel 100 through the vibration transfer member 600 to output a sound SW. At this time, because a displacement caused by the vibration of the vibration generating device 300 is less than a distance between the horizontal portion 440*b* of the buffer member 400 and the vibration generating device 300, the horizontal portion 400*b* of the buffer member 400 may not contact the vibration generating device 300 even when the vibration generating device 300 vibrates to output the sound SW.

However, as shown in FIG. 13, when an external impact is applied to the display panel 100, a displacement of the vibration generating device 300 may increase as compared to a displacement caused by a vibration, and the horizontal portion 400*b* of the buffer member 400 may contact the vibration generating device 300 to define or limit a maximum displacement of the vibration generating device 300. For example, when an external impact is applied to a display apparatus that does not include the buffer member 400, the external impact may be transferred to the vibration generating device 300, causing damage of the vibration generating device 300. Accordingly, even when an external impact is applied to the display panel 100, the buffer member 400 may define or limit a maximum displacement of the vibration generating device 300, thereby preventing or reducing the vibration generating device 300 from being damaged or broken down.

According to an embodiment, the buffer member 400 may have an elastic force that is higher than that of the vibration transfer member 600. For example, the vibration transfer member 600 may be disposed between the display panel 100 and the vibration generating device 300 to transfer a vibration generated by the vibration generating device 300 to the display panel 100, and the buffer member 400 may be attached on a rear surface of the rear structure 200 to define or limit a maximum displacement of the vibration generating device 300 when an external impact is applied to the display panel 100. Accordingly, the buffer member 400 may prevent or reduce an external impact applied to the display panel 100 from being transferred to the vibration generating device 300 through the vibration transfer member 600. Thus, the maximum displacement of the vibration generating device 300 inserted into the through hole 210 may be defined or limited.

Figure 14:
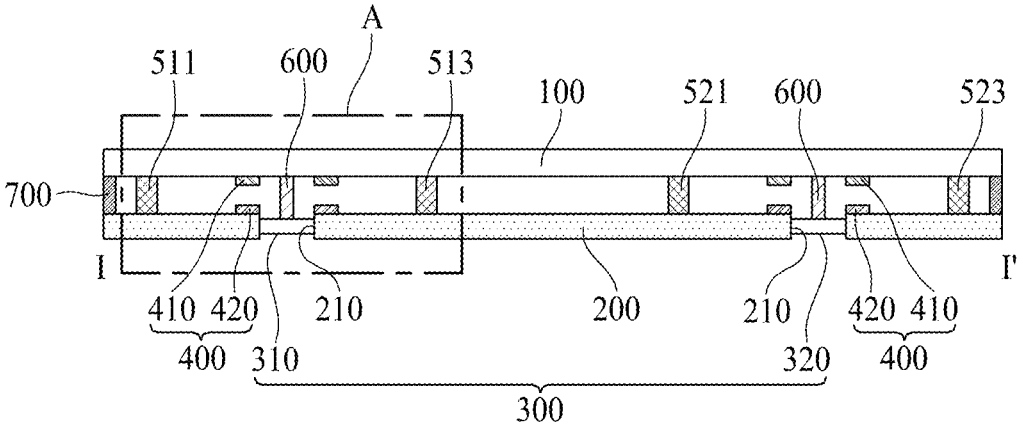
FIG. 14 is a cross-sectional view of a display apparatus according to a fourth embodiment of the present disclosure.

FIG. 14 is a cross-sectional view of a display apparatus according to a fourth embodiment of the present disclosure.

Figure 15A:
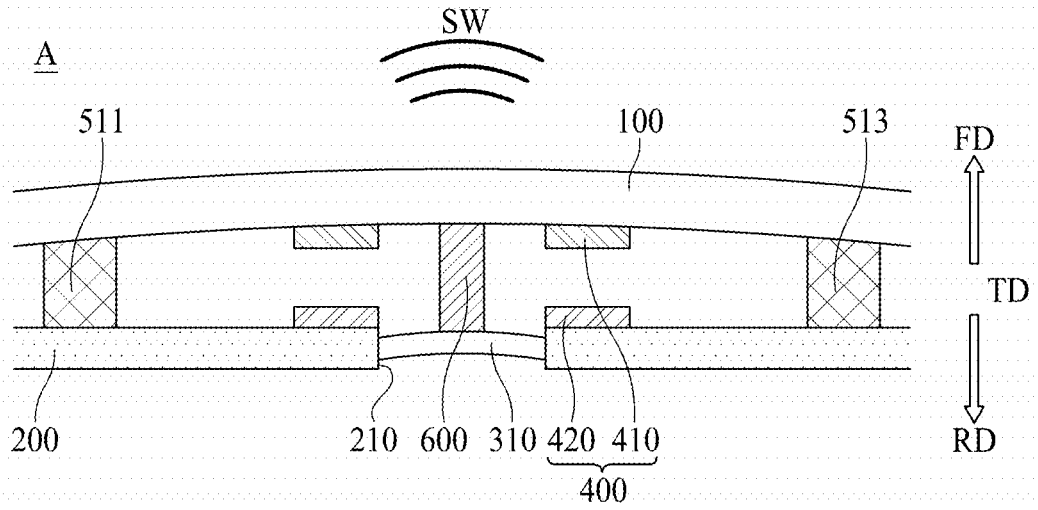
FIGS. 15A and 15B are diagrams illustrating a display panel vibrated by a vibration generating device in region A of FIG. 14.
Figure 15B:
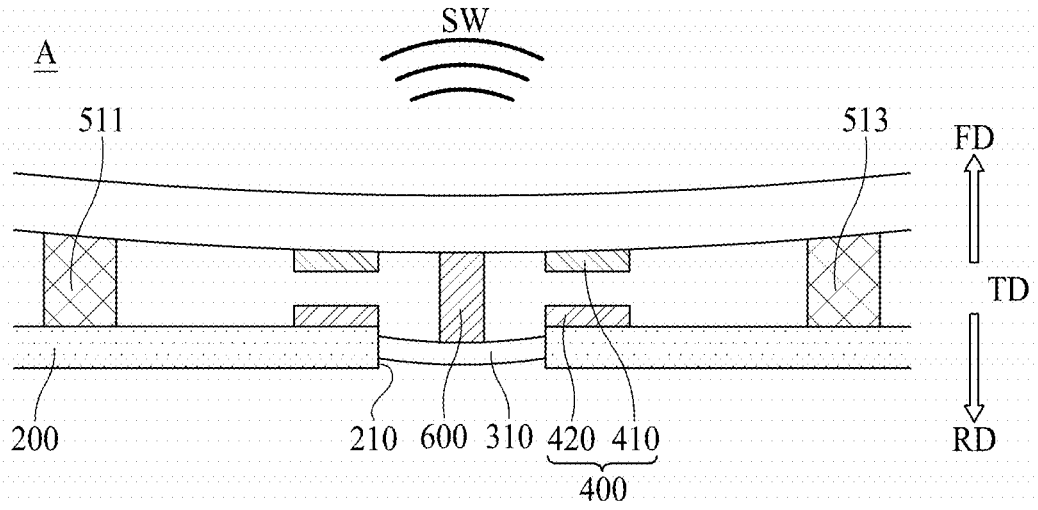
Figure 16:
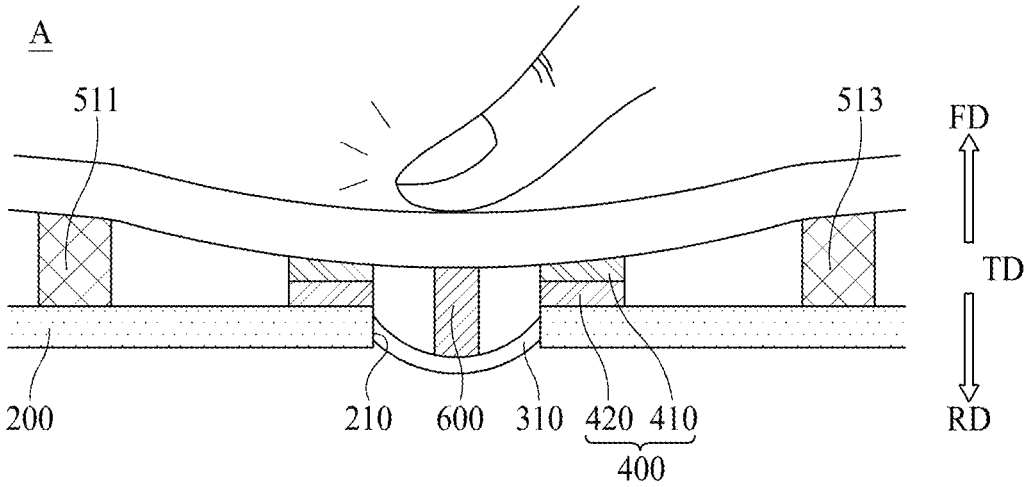
FIG. 16 is a diagram illustrating a display apparatus to which an external impact is applied in region A of FIG. 14.

FIGS. 15A and 15B are diagrams illustrating a display panel vibrated by a vibration generating device in region A of FIG. 14. FIG. 16 is a diagram illustrating a display apparatus to which an external impact is applied in region A of FIG. 14. Here, at least a buffer member 400 may be modified. The same or similar elements as the above-described elements will be briefly described or are not described.

With reference to FIGS. 14 to 16, a buffer member 400 may a first buffer member 410 attached on a display panel 100 and a second buffer member 420 attached to a rear structure 200 and may define or limit a maximum displacement of a vibration generating device 300. The first buffer member 410 may be attached to one surface of the display panel 100 facing the rear structure 200, the second buffer member 420 may be attached to one surface of the rear structure 200 facing the display panel 100, and each of the first and second buffer members 410 and 420 may surround a vibration transfer member 600 spaced apart therefrom. For example, the first buffer member 410 may be attached on a rear surface of the display panel 100, a front surface of the display panel 100 may correspond to a surface that displays an image, and a rear surface of the display panel 100 may correspond to an opposite surface with respect to the front surface. Also, the second buffer member 420 may be attached to a front surface of the rear structure 200, and the front surface of the rear structure 200 may correspond to one surface of the rear structure 200 facing the display panel 100.

The first and second buffer members 410 and 420 may not overlap a through hole 210 of the rear structure 200, but may be disposed in a region adjacent to the through hole 210. The first and second buffer members 410 and 420 may be disposed maximally adjacent to the through hole 210 and maximally apart from a partition member 500. For example, the first buffer member 410 may be attached on the display panel 100 and spaced apart from the rear structure 200 and the partition member 500 may be disposed between the display panel 100 and the rear structure 200. Thus, if the first and second buffer members 410 and 420 are provided farther away from the partition member 500, the first and second buffer members 410 and 420 may define or limit a maximum displacement of the vibration generating device 300 inserted into the through hole 210 when an external impact occurs.

Each of the first and second buffer members 410 and 420 may be provided in plurality, adjacent first buffer members 410 may be disposed symmetrically with respect to the vibration transfer member 600, and adjacent second buffer members 420 may be disposed symmetrically with respect to the vibration transfer member 600. For example, as in left and right portions and upper, lower, left, and right portions of the vibration transfer member 600, adjacent first buffer members 410 may be disposed symmetrically with respect to the vibration transfer member 600, and adjacent second buffer members 420 may be disposed symmetrically with respect to the vibration transfer member 600. The vibration transfer member 600 may overlap a center portion of the through hole 210 or a sound generating module 310, and each of the first and second buffer members 410 and 420 may be disposed adjacent to the through hole 210 or the sound generating module 310, whereby each of the first and second buffer members 410 and 420 may surround the vibration transfer member 600 to be spaced apart from the vibration transfer member 600.

The first and second buffer members 410 and 420 may overlap each other. Also, a sum of thicknesses of the first and second buffer members 410 and 420 may be less than that of the partition member 500 disposed between the display panel 100 and the rear structure 200. Here, a thickness of each of the first and second buffer members 410 and 420 and the partition member 500 may be measured in the same direction as a thickness of each of the display panel 100 and the rear structure 200. When the vibration generating device 300 vibrates the display panel 100, the first and second buffer members 410 and 420 may be separated from each other, and when an external impact is applied to the display panel 100, the first and second buffer members 410 and 420 may contact each other. For example, a height of the partition member 500 disposed between the display panel 100 and the rear structure 200 may be higher in position than a sum of heights of the first and second buffer members 410 and 420. Also, a displacement caused by a vibration of the display panel 100 may be less than a distance between the first and second buffer members 410 and 420.

For example, as shown in FIGS. 15A and 15B, the vibration generating device 300 may vibrate the display panel 100 through the vibration transfer member 600 to output a sound SW. At this time, because a displacement caused by the vibration of the display panel 100 is less than a distance between the first and second buffer members 410 and 420, the first and second buffer members 410 and 420 may not contact each other even when the display panel 100 vibrates.

However, as shown in FIG. 16, when an external impact is applied to the display panel 100, a displacement of the display panel 100 may increase as compared to a displacement caused by a vibration, and the first and second buffer members 410 and 420 may contact each other and may define or limit a maximum displacement of the vibration generating device 300. For example, when an external impact is applied to a display apparatus that does not include the first and second buffer members 410 and 420, the external impact may be transferred to the vibration generating device 300, causing damage of the vibration generating device 300. Therefore, even when an external impact is applied to the display panel 100, the first and second buffer members 410 and 420 according to the present disclosure may define or limit a maximum displacement of the vibration generating device 300, thereby preventing or reducing the vibration generating device 300 from being damaged or broken down. Also, the display apparatus according to the present disclosure may include the first and second buffer members 410 and 420. Thus, concerns regarding external impacts applied to the vibration generating device 300 may be reduced as compared to a case where the display apparatus includes only one buffer member.

Figure 17:
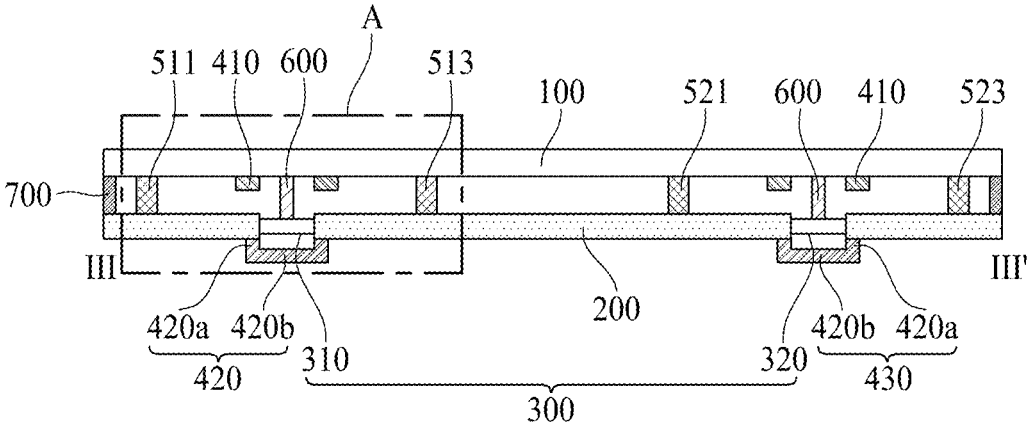
FIG. 17 is a cross-sectional view of a display apparatus according to a fifth embodiment of the present disclosure.
Figure 18A:
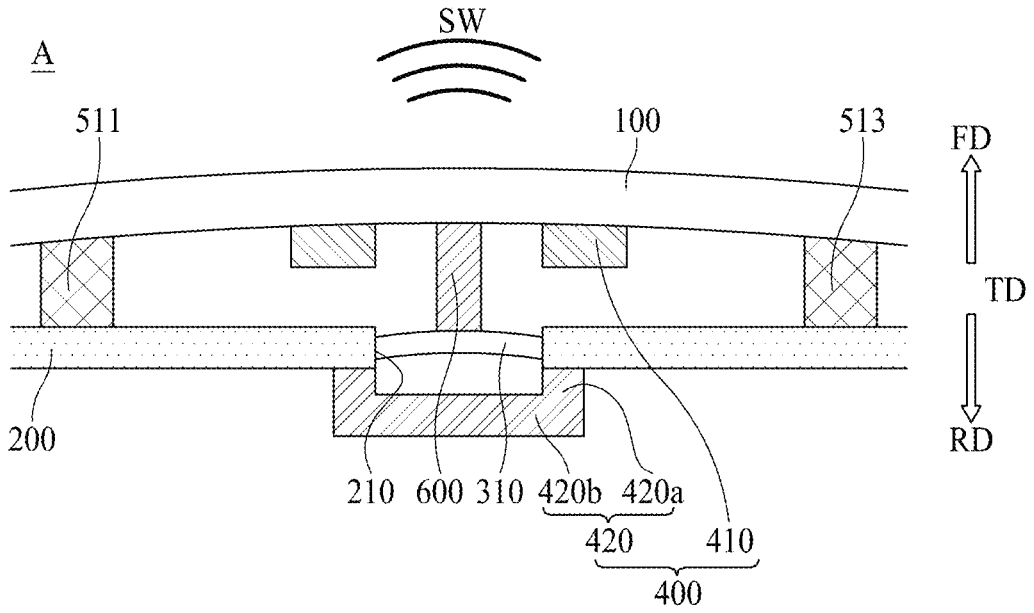
FIGS. 18A and 18B are diagrams illustrating a display panel vibrated by a vibration generating device in region A of FIG. 17.
Figure 18B:
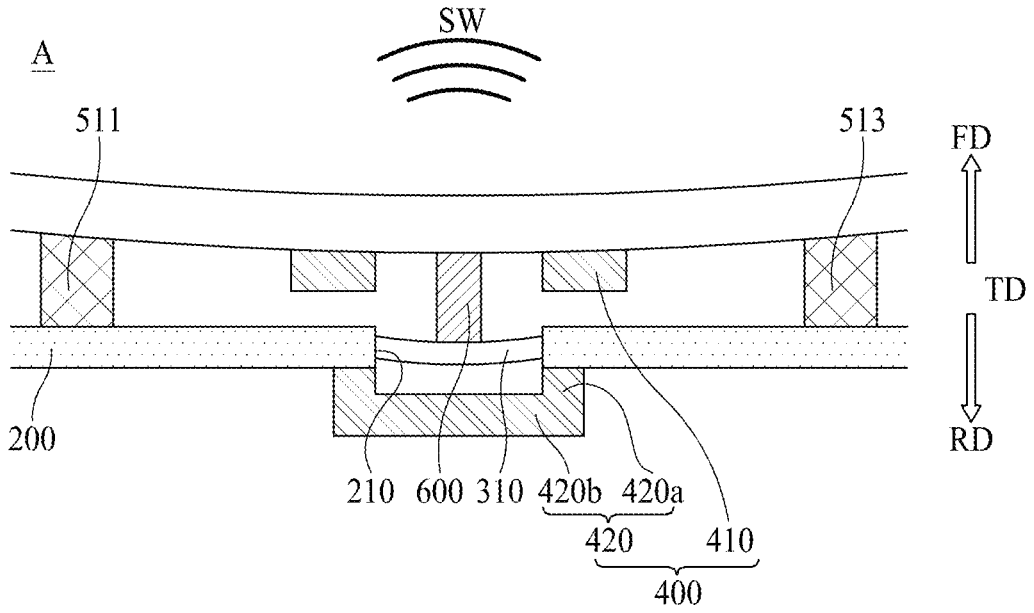
Figure 19:
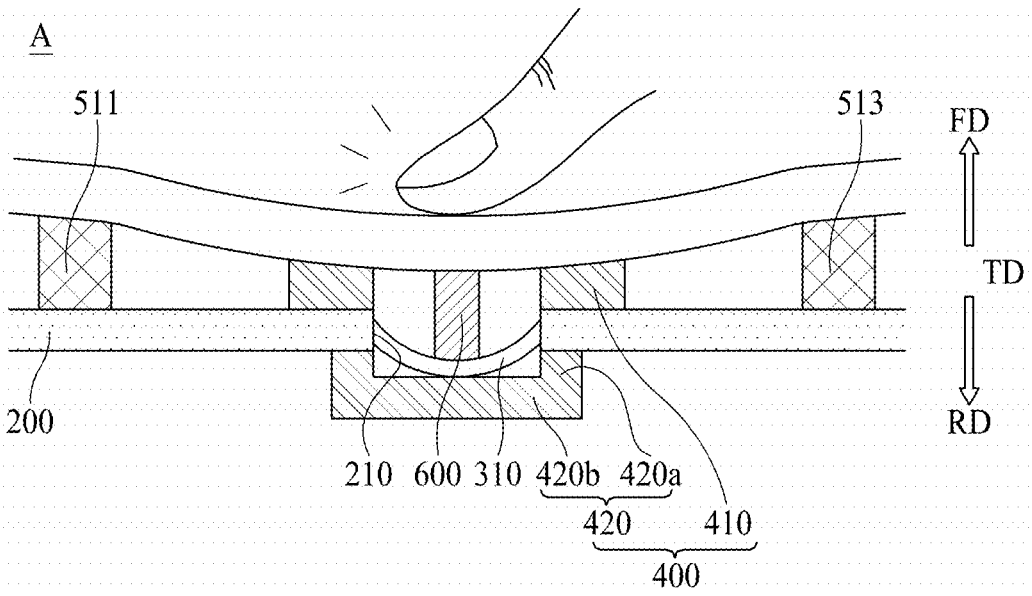
FIG. 19 is a diagram illustrating a display apparatus to which an external impact is applied in region A of FIG. 17.

FIG. 17 is a cross-sectional view of a display apparatus according to a fifth embodiment of the present disclosure. FIGS. 18A and 18B are diagrams illustrating a display panel vibrated by a vibration generating device in region A of FIG. 17. FIG. 19 is a diagram illustrating a display apparatus to which an external impact is applied in region A of FIG. 17. Here, at least a buffer member 400 is modified. The same or similar elements as the above-described elements will be briefly described or are not described.

With reference to FIGS. 17 to 19, a buffer member 400 may include a first buffer member 410 attached on a display panel 100 and a second buffer member 420 attached on a rear structure 200, and may define or limit a maximum displacement of a vibration generating device 300. The first buffer member 410 may be attached on one surface of the display panel 100 facing the rear structure 200 and may surround the vibration transfer member 600 spaced apart from the first buffer member 410, and the second buffer member 420 may be attached on the other surface opposite to one surface of the rear structure 200 facing the display panel 100 and may overlap the vibration transfer member 600. For example, the first buffer member 410 may be attached to a rear surface of the display panel 100, a front surface of the display panel 100 may correspond to a surface that displays an image, and a rear surface of the display panel 100 may correspond to an opposite surface with respect to the front surface. Also, the second buffer member 420 may be attached to a rear surface of the rear structure 200, and the rear surface of the rear structure 200 may correspond to the other surface opposite to the one surface of the rear structure 200 facing the display panel 100.

The first buffer member 410 may not overlap a through hole 210, but may be disposed in a region adjacent to the through hole 210. The second buffer member 420 may be disposed to overlap the through hole 210.

A thickness of the first buffer member 410 may be less than that of the partition member 500 disposed between the display panel 100 and the rear structure 200. Here, a thickness of each of the first buffer member 410 and the partition member 500 may be measured in the same direction as a thickness of each of the display panel 100 and the rear structure 200. If the first buffer member 410 is disposed adjacent to the through hole 210 and far apart from a partition member 500, the first buffer member 410 may define or limit a maximum displacement of the vibration generating device 300 inserted into the through hole 210 when an external impact occurs.

Moreover, the second buffer member 420 may include a vertical portion 420*a* and a horizontal portion 420*b*. The vertical portion 420*a* of the second buffer member 420 may be attached on the rear surface of the rear structure 200. The vertical portion 420*a* may be disposed in a region adjacent to the through hole 210 to support the horizontal portion 420*b* overlapping the through hole 210. For example, the vertical portion 420*a* may extend from the rear surface of the rear structure 200 to a rearward region behind the display apparatus to support the horizontal portion 420*b*.

The horizontal portion 420*b* of the second buffer member 420 may overlap the through hole 210 and the vibration generating device 300 and may be disposed in parallel with the vibration generating device 300. Also, a distance between the horizontal portion 420*b* of the second buffer member 420 and the vibration generating device 300 may be less than a thickness of the partition member 500 disposed between the display panel 100 and the rear structure 200. According to an embodiment, the horizontal portion 420*b* may be disposed in parallel with the vibration generating device 300, and thus, when an external impact is applied to the display panel 100, the horizontal portion 420*b* may directly contact the vibration generating device 300 to define or limit a maximum displacement of the vibration generating device 300.

For example, as shown in FIGS. 18A and 18B, the vibration generating device 300 may vibrate the display panel 100 through the vibration transfer member 600 to output a sound SW. At this time, because a displacement caused by the vibration of the vibration generating device 300 is less than a distance between the first buffer member 410 and the rear structure 200, the first buffer member 410 may not contact the rear structure 200 even when the display panel 100 vibrates. Also, because a displacement caused by the vibration of the display panel 100 is less than a distance between the second buffer member 420 and the vibration generating device 300, the second buffer member 420 may not contact the vibration generating device 300 even when the vibration generating device 300 vibrates.

However, as shown in FIG. 19, when an external impact is applied to the display panel 100, a displacement of the display panel 100 may increase compared to a displacement caused by a vibration, the first buffer member 410 may contact the rear structure 200, and the second buffer member 420 may contact the vibration generating device 300, thereby defining or limiting a maximum displacement of the vibration generating device 300. For example, when an external impact is applied to a display apparatus that does not include the first and second buffer members 410 and 420, the external impact may be transferred to the vibration generating device 300, causing damage of the vibration generating device 300.

Therefore, even when an external impact is applied to the display panel 100, the first and second buffer members 410 and 420 according to the present disclosure may limit a maximum displacement of the vibration generating device 300, thereby preventing or reducing the vibration generating device 300 from being damaged or broken down. Also, the display apparatus according to the present disclosure may include the first and second buffer members 410 and 420. Thus, concerns regarding external impacts applied to the vibration generating device 300 may be reduced as compared to a case where the display apparatus includes only one buffer member.

Moreover, the display panel applied to the display apparatus according to an embodiment of the present disclosure may be one of any type of display panel, such as a liquid crystal display panel, an organic light emitting diode display panel, a quantum dot light emitting display panel, and an electroluminescent display panel, but is not limited to a specific display panel. For example, the display panel according to the present disclosure may use any display panels that are vibrated by the sound generating device according to the present disclosure to generate a sound. Also, the display apparatus according to an embodiment of the present disclosure may include a display panel including an organic light emitting layer, a quantum dot light emitting layer, and a micro light emitting diode.

Moreover, the vibration generating device according to an embodiment of the present disclosure may be applied to display apparatuses. The display apparatus according to an embodiment of the present disclosure may be applied to mobile devices, video phones, smart watches, watch phones, wearable devices, foldable devices, rollable devices, bendable devices, flexible devices, curved devices, portable multimedia players (PMPs), personal digital assistants (PDAs), electronic organizers, desktop personal computers (PCs), laptop PCs, netbook computers, workstations, navigation devices, automotive navigation devices, automotive display devices, televisions (TVs), notebook computers, monitors, cameras, camcorders, home appliances, etc.

According to an embodiment of the present disclosure, a display apparatus may comprise a display panel configured to display an image; a rear structure supporting the display panel and including a through hole in a thickness direction; a vibration generating device including at least one sound generating module in the through hole to vibrate the display panel; a vibration transfer member between the display panel and the vibration generating device, the vibration transfer member configured to transfer a vibration of the vibration generating device to the display panel; and a buffer member on one of the display panel and the rear structure.

According to one or more embodiments, the buffer member may be attached to a surface of the display panel facing the rear structure. The buffer member may surround the vibration transfer member and may be spaced apart therefrom. The display apparatus may further comprise a partition member between the display panel and the rear structure, wherein a thickness of the buffer member is less than a thickness of the partition member. The buffer member may be one of a plurality of buffer members such that adjacent ones of the buffer members are disposed symmetrically with respect to the vibration transfer member.

According to one or more embodiments, the buffer member may be attached to a surface of the rear structure facing the display panel. The buffer member may surround the vibration transfer member and may be spaced apart therefrom. The display apparatus may further comprise a partition member between the display panel and the rear structure, wherein a thickness of the buffer member is less than a thickness of the partition member. The buffer member may be one of a plurality of buffer members such that adjacent ones of the buffer members are disposed symmetrically with respect to the vibration transfer member.

According to one or more embodiments, the buffer member may be attached to another surface opposite to one surface of the rear structure facing the display panel and is disposed to overlap the through hole. The buffer member may comprise a vertical portion attached to a rear surface of the rear structure and a horizontal portion disposed in parallel with the vibration generating device to overlap the through hole. The display apparatus may further comprise a partition member between the display panel and the rear structure, wherein a distance between the horizontal portion and the vibration generating device is less than a thickness of the partition member. The buffer member may define a maximum displacement of the vibration generating device and of the display panel.

According to an embodiment of the present disclosure, a display apparatus may comprise a display panel configured to display an image; a rear structure supporting the display panel and including a through hole bored along a thickness direction; a vibration generating device including at least one sound generating module inserted into the through hole to vibrate the display panel; a vibration transfer member between the display panel and the vibration generating device, the vibration transfer member configured to transfer a vibration of the vibration generating device to the display panel; and a buffer member including a first buffer member attached to the display panel and a second buffer member attached to the rear structure.

According to one or more embodiments, the first buffer member may be attached to a surface of the display panel facing the rear structure, and the second buffer member may be attached to a surface of the rear structure facing the display panel. The first buffer member may overlap the second buffer member. The display apparatus may further comprise a partition member between the display panel and the rear structure, wherein a sum of thicknesses of the first and second buffer members is less than a thickness of the partition member. The first buffer member may be attached to a surface of the display panel facing the rear structure, and the second buffer member may be attached to another surface opposite to a surface of the rear structure facing the display panel and is disposed to overlap the through hole. The second buffer member may comprise a vertical portion attached to a rear surface of the rear structure and a horizontal portion disposed in parallel with the vibration generating device to overlap the through hole. The display apparatus may further comprise a partition member between the display panel and the rear structure, wherein a thickness of the first buffer member is less than a thickness of the partition member, and wherein a distance between the horizontal portion of the second buffer member and the vibration generating device is less than the thickness of the partition member.

It will be apparent to those skilled in the art that various modifications and variations can be made in the display apparatus of the present disclosure without departing from the spirit or scope of the disclosure. Thus, it is intended that the present disclosure covers the modifications and variations of this disclosure provided they come within the scope of the appended claims and their equivalents.

What is claimed is:

1. A display apparatus, comprising:

a display panel configured to display an image;

a rear structure supporting the display panel and including a through hole in a thickness direction;

a vibration generating device including at least one sound generating module in the through hole to vibrate the display panel;

a vibration transfer member between the display panel and the vibration generating device, the vibration transfer member configured to transfer a vibration of the vibration generating device to the display panel; and a buffer member on one of the display panel and the rear structure, wherein the at least one sound generating module includes a piezoelectric element, and wherein the at least one sound generating module is convexly or concavely displaced in the through hole of the rear structure.

2. The display apparatus of claim 1, wherein the buffer member is attached to a surface of the display panel facing the rear structure.

3. The display apparatus of claim 2, wherein the buffer member surrounds the vibration transfer member and is spaced apart therefrom.

4. The display apparatus of claim 2, further comprising a partition member between the display panel and the rear structure, wherein a thickness of the buffer member is less than a thickness of the partition member.

5. The display apparatus of claim 2, wherein the buffer member is one of a plurality of buffer members such that adjacent ones of the buffer members are disposed symmetrically with respect to the vibration transfer member.

6. The display apparatus of claim 1, wherein the buffer member is attached to a surface of the rear structure facing the display panel.

7. The display apparatus of claim 6, wherein the buffer member surrounds the vibration transfer member and is spaced apart therefrom.

8. The display apparatus of claim 6, further comprising a partition member between the display panel and the rear structure, wherein a thickness of the buffer member is less than a thickness of the partition member.

9. The display apparatus of claim 6, wherein the buffer member is one of a plurality of buffer members such that adjacent ones of the buffer members are disposed symmetrically with respect to the vibration transfer member.

10. The display apparatus of claim 1, wherein the buffer member is attached to another surface opposite to one surface of the rear structure facing the display panel and is disposed to overlap the through hole.

11. The display apparatus of claim 10, wherein the buffer member comprises:

a vertical portion attached to a rear surface of the rear structure; and a horizontal portion disposed in parallel with the vibration generating device to overlap the through hole.

12. The display apparatus of claim 11, further comprising a partition member between the display panel and the rear structure, wherein a distance between the horizontal portion and the vibration generating device is less than a thickness of the partition member.

13. The display apparatus of claim 1, wherein the buffer member defines a maximum displacement of the vibration generating device and of the display panel.

14. A display apparatus, comprising:

a display panel configured to display an image;

a rear structure supporting the display panel and including a through hole bored along a thickness direction;

a vibration generating device including at least one sound generating module inserted into the through hole to vibrate the display panel;

a vibration transfer member between the display panel and the vibration generating device, the vibration transfer member configured to transfer a vibration of the vibration generating device to the display panel; and a buffer member including a first buffer member attached to the display panel and a second buffer member attached to the rear structure, wherein the at least one sound generating module includes a piezoelectric element, and wherein a thickness of the at least one sound generating module is thinner than a thickness of the rear structure.

15. The display apparatus of claim 14, wherein the first buffer member is attached to a surface of the display panel facing the rear structure, and the second buffer member is attached to a surface of the rear structure facing the display panel.

16. The display apparatus of claim 14, wherein the first buffer member overlaps the second buffer member.

17. The display apparatus of claim 16, further comprising a partition member between the display panel and the rear structure, wherein a sum of thicknesses of the first and second buffer members is less than a thickness of the partition member.

18. The display apparatus of claim 14, wherein the first buffer member is attached to a surface of the display panel facing the rear structure, and wherein the second buffer member is attached to another surface opposite to a surface of the rear structure facing the display panel and is disposed to overlap the through hole.

19. The display apparatus of claim 18, wherein the second buffer member comprises:

a vertical portion attached to a rear surface of the rear structure; and a horizontal portion disposed in parallel with the vibration generating device to overlap the through hole.

20. The display apparatus of claim 19, further comprising a partition member between the display panel and the rear structure, wherein a thickness of the first buffer member is less than a thickness of the partition member, and wherein a distance between the horizontal portion of the second buffer member and the vibration generating device is less than the thickness of the partition member.

21. The display apparatus of claim 1, wherein a thickness of the at least one sound generating module is thinner than a thickness of the rear structure.

22. The display apparatus of claim 14, wherein the at least one sound generating module is convexly or concavely displaced in the through hole of the rear structure.

* * * * *